US006438190B2

(12) United States Patent
Gluschke et al.

(10) Patent No.: US 6,438,190 B2
(45) Date of Patent: Aug. 20, 2002

(54) MAKING STORAGE/TRANSPORT CONTAINER FOR RADIOACTIVE MATERIAL

(75) Inventors: Konrad Gluschke, Wickede; Rudolf Diersch, Essen; Dieter Methling, Hattingen, all of (DE)

(73) Assignee: GNB Gesellschaft fur Nuklear-Behalter mbH, Essen (DE)

( * ) Notice: Subject to any disclaimer, the term of this patent is extended or adjusted under 35 U.S.C. 154(b) by 0 days.

(21) Appl. No.: 09/728,604

(22) Filed: Dec. 1, 2000

(30) Foreign Application Priority Data

Dec. 15, 1999 (EP) ..... 99125003

(51) Int. Cl.[7] ..... G21C 19/00; G21F 7/00
(52) U.S. Cl. ..... 376/260; 376/272; 250/515.1
(58) Field of Search ..... 376/272; 250/515.1, 250/518.1, 506.1, 507.1; 52/319–341, 745.07, 741.4, 742.1–742.15

(56) References Cited

U.S. PATENT DOCUMENTS 4,257,912 A * 3/1981 Fleischer et al. ..... 588/4
4,845,372 A * 7/1989 Mallory et al. ..... 250/506.1
5,402,455 A * 3/1995 Angelo, II et al. ..... 376/272
5,545,796 A * 8/1996 Roy et al. ..... 588/4
5,786,611 A * 7/1998 Quapp et al. ..... 250/515.1
5,819,186 A * 10/1998 Stephens ..... 588/3

FOREIGN PATENT DOCUMENTS

DE 2831646 A1 * 1/1980 ..... 376/272
GB 2096046 A * 10/1982 ..... 376/272
WO 98 59346 12/1998 ..... 250/515.1

* cited by examiner

*Primary Examiner*—Charles T. Jordan
*Assistant Examiner*—Daniel Matz
(74) *Attorney, Agent, or Firm*—Herbert Dubno; Andrew Wilford

(57) ABSTRACT

A storage/transport container for radioactive material is made by first subdividing a chamber formed between an inner shell and an outer shell into first and second compartments by means of a foraminous partition having a predetermined maximum mesh size. Then an aggregate of a predetermined minimum particle size greater than the predetermined maximum mesh size is introduced into one of the compartments and a suspension of cement and water is introduced into the first compartment such that the aggregate remains in the one compartment and the cement and water flow through the partition into the second compartment. Normally the aggregate and the suspension are both introduced into the same compartment.

10 Claims, 3 Drawing Sheets

MAKING STORAGE/TRANSPORT CONTAINER FOR RADIOACTIVE MATERIAL

FIELD OF THE INVENTION

The present invention relates to a storage/transport container for radioactive material. More particularly this invention concerns such a container and a method of making it.

BACKGROUND OF THE INVENTION

A storage/transport container for spent nuclear-fuel rods or the like is typically formed like a barrel and has inner and outer spaced shells forming a cylindrical intermediate space. The chamber is filled with aggregate and a suspension of cement, water, and additives to form a concrete mass. The aggregate which is used to impart strength to the container has a minimum particle size.

In a known method described in WO 98/59346 the entire space between the shells is filled with the same concrete mix. Containers made in this way are suitable only for shielding radiation sources having relatively low neutron source strength, for example low-burn-out fuel elements. If a container of this kind is to be used for radiation sources with high-dosage neutron source strength, e.g. MOX fuel elements or vitrified highly active waste from reprocessing, relatively thick concrete walls are required to hold the water needed for the neutron shielding.

OBJECTS OF THE INVENTION

It is therefore an object of the present invention to provide an improved a storage/transport container for radioactive waste materials.

Another object is the provision of an improved method of making a storage/transport container for radioactive waste materials which overcomes the above-given disadvantages, that is which can produce a container with adequate n-shielding without having to resort to large wall thicknesses or complex manufacturing methods.

SUMMARY OF THE INVENTION

A storage/transport container for radioactive material is made according to the invention by first subdividing a chamber formed between an inner shell and an outer shell into first and second compartments by means of a foraminous partition having a predetermined maximum mesh size. Then an aggregate of a predetermined minimum particle size greater than the predetermined maximum mesh size is introduced into one of the compartments and a suspension of cement and water is introduced into either of the compartments such that the aggregate remains in the one compartment and the cement and water flow through the partition to fill both compartments. Normally according to the invention the aggregate and the suspension are both introduced into the same compartment.

With this arrangement, therefore, the aggregate will be restricted to the one compartment it is introduced into while the grout-like suspension will fill the other compartment. This forms standard concrete with the aggregate to produce the requisite container strength while providing a layer with a high water content for best n-shielding.

The partition according to the invention is formed by a perforated screen, plate, or netting. Its mesh size is between 2 mm and 4 mm.

The partition is supported between the shells on webs bridging the chamber and bearing on the shells. More particularly the partition can be supported between the shells on an inner array of inner webs and an outer array of outer webs. in this case the partition is shaped to fit complementarily with the inner and outer webs. The inner and outer webs are arrayed in pairs interconnected by respective inner and outer bridges secured to the respective shells. The partition can be welded to the webs.

As mentioned above, the one compartment is the second compartment so that the aggregate and cement/water suspension are introduced into the same compartment. More particularly the one and second compartment are an inner compartment adjacent the inner shell. The other and first compartment is an outer compartment adjacent the outer shell.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
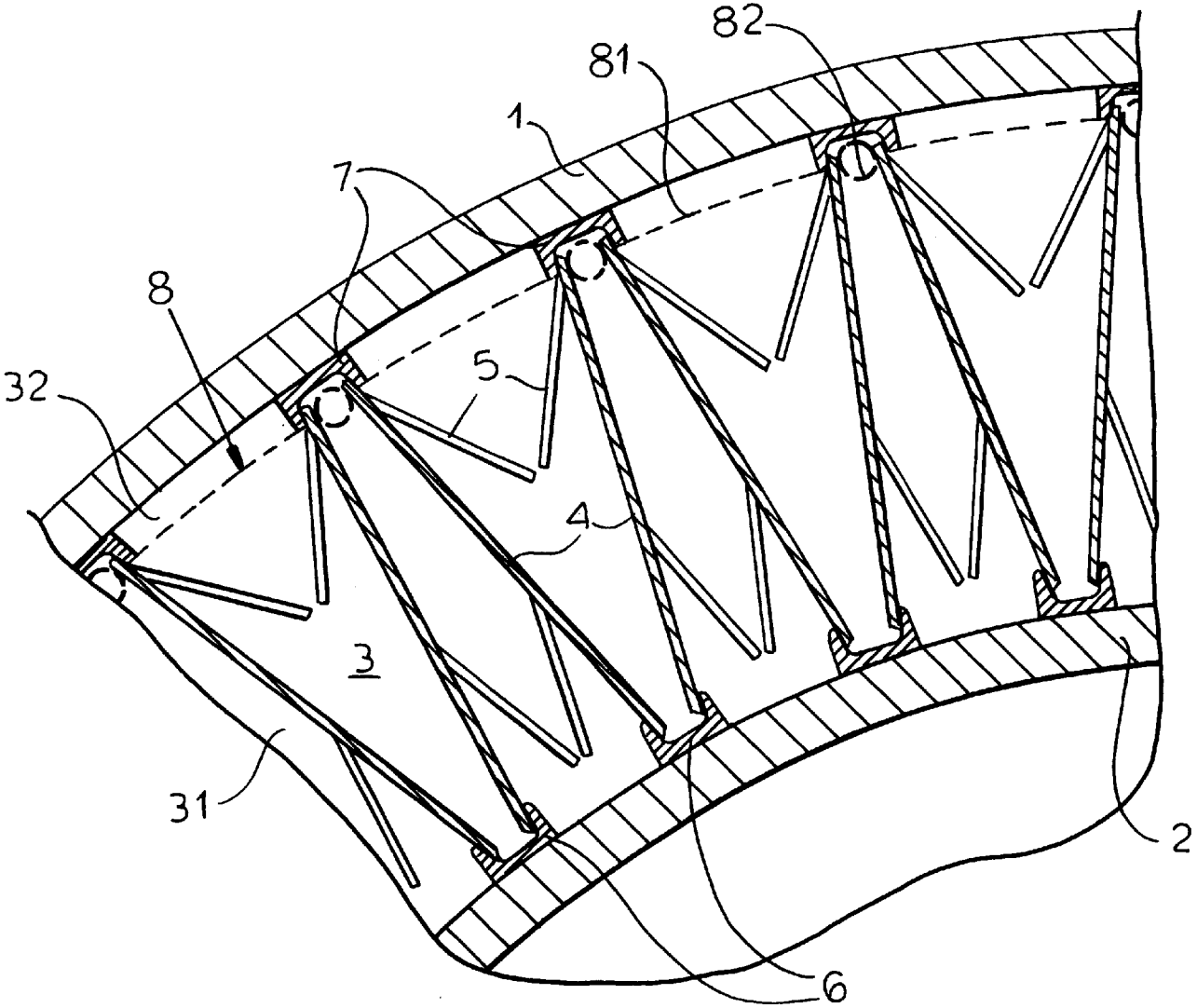
FIG. 1 is a horizontal section through a detail of a container being manufactured according to the invention.
Figure 3:
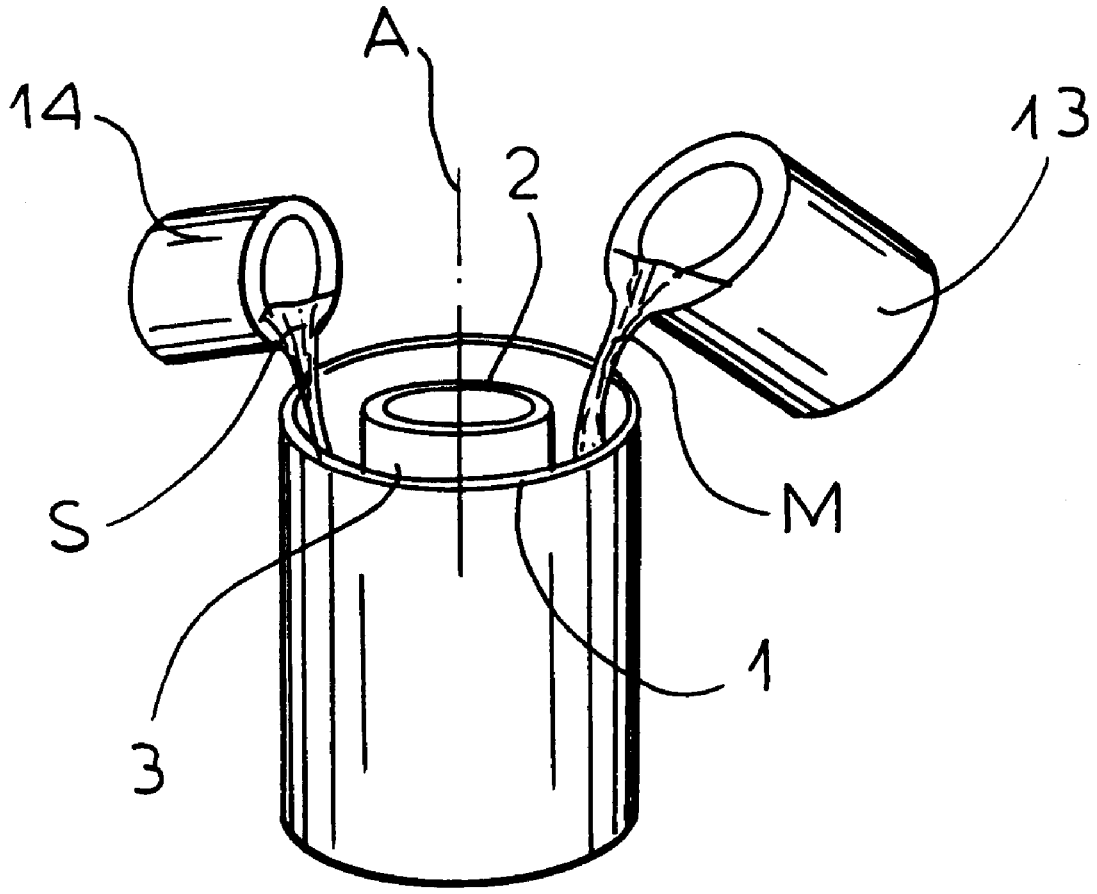
FIG. 3 is a small-scale perspective view illustrating the method of this invention.

As seen in FIG. 1 a storage container for radioactive articles is formed of a metal outer shell 1 and a metal inner shell 2 disposed coaxially therewith relative to a center axis A (FIG. 3). An initially empty cylindrically annular intermediate space 3 is thus formed between the outer shell 1 and the inner shell 2. Webs 4 of a thermally conductive material extend between the inner shell 2 and the outer shell 1 and have extended window elements 5. These thermally conductive radial webs 4 are welded to U-bars 6 which are in turn fixed on the inner shell 2. U-bars 7 are also fixed on the outer shell 1 but the thermally conductive radial webs 4 only bear against them and are not permanently attached thereto.

A perforated or otherwise foraminous diaphragm or partition 8 subdivides the chamber or space 3 into two concentric compartments 31 and 32. The partition 8 is formed by open and closed profiles 81 or 82 of perforate screen, plate, or wire netting inserted between the thermally conductive radial webs 4 and bearing against and welded thereto.

As shown in FIG. 3, to complete the container, a mass M of concrete aggregate having a minimum particle size is introduced from a vessel 13 into the inner compartment 31 and then a suspension S of cement, water and additives is introduced from another vessel 14 into the inner compartment 31. The mesh or opening size of the partition 8 is such that only the suspension S passes into the outer compartment 32. It is possible to introduce the aggregate mass M into one of the compartments and the suspension S separately into the other compartment, or introduce the two simultaneously into one of the compartments.

Figure 2:
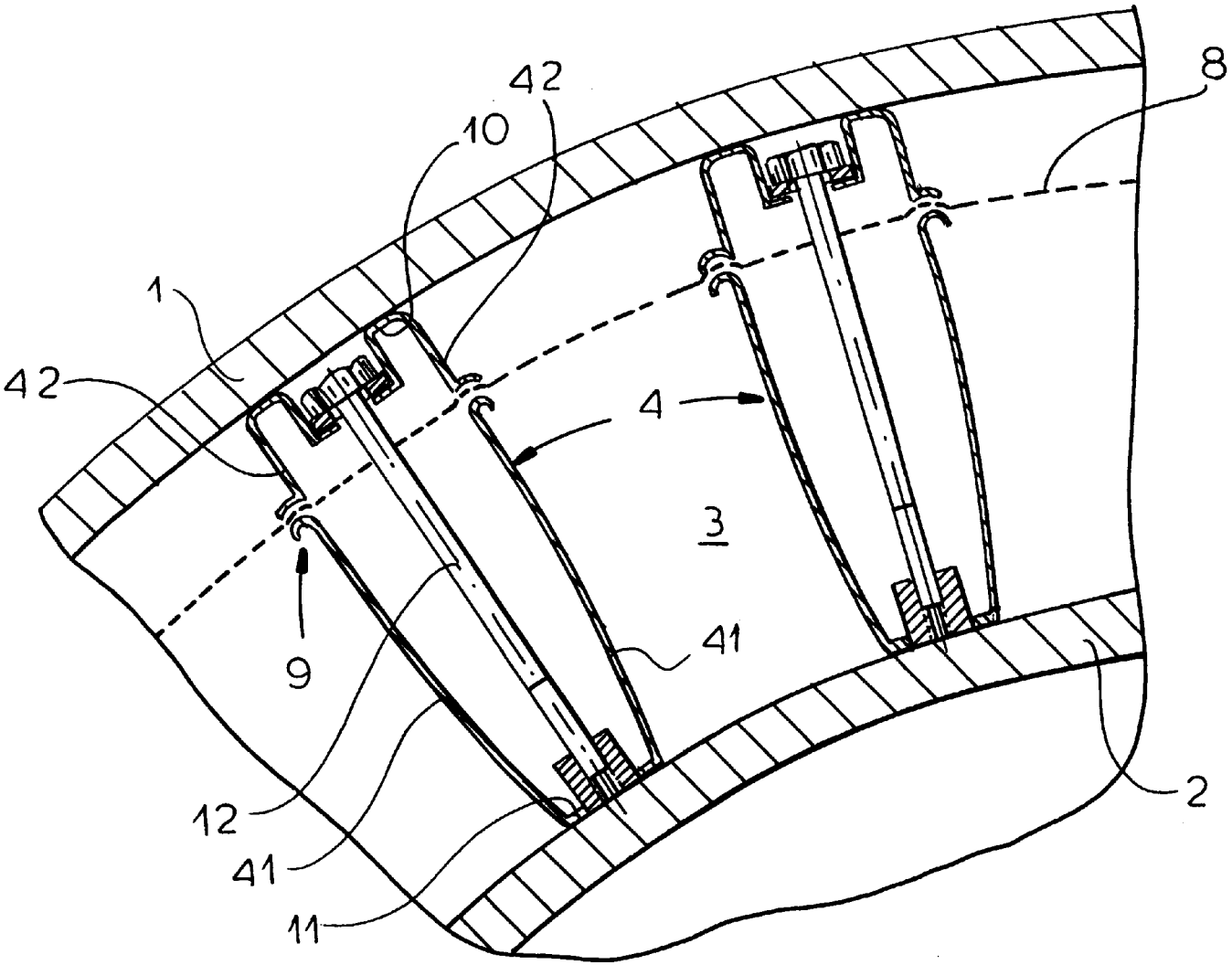
FIG. 2 is a similar view of another container in accordance with the invention.

In the embodiment shown in FIG. 2, the partition 8 is held by an inner sub-array 41 of thermally conductive radial webs 4 and a complementary outer sub-array 42 of webs is placed on the partition 8 and is screwed to the inner shell 2. In these conditions, the partition 8, the inner web sub-array 41 and the outer web sub-array 42 are fitted together at complementary longitudinal corrugations 9. Each pair of adjacent radial sub-webs of the outer sub-array 42 is interconnected by a respective external bridge 10. Correspondingly, each pair of adjacent radial webs of the inner sub-array 41 are interconnected by a respective inner bridge 11. The screw connection 12 is made through the outer bridge 10 and the partition 8 to the inner shell 2. The outer shell 1 has been placed in position with elastic deformation of the thermally conductive radial webs 4. Filling is effected in the same way as indicated above. The composition of the mass M can be the same as that described in WO 98/59346.

We claim:

1. A method of making a storage/transport container for radioactive material, the method comprising the step of:

subdividing a chamber formed between an inner shell and an outer shell into first and second compartments by means of a foraminous partition having a predetermined maximum mesh size;

introducing into one of the compartments an aggregate of a predetermined minimum particle size greater than the predetermined maximum mesh size; and introducing into the first compartment a suspension of cement and water such that the aggregate remains in the one compartment and the cement and water flow through the partition into the second compartment 7.

2. The container-making method defined in claim 1 wherein the partition is formed by a perforated screen, plate, or netting.

3. The container-making method defined in claim 1 wherein the mesh size is between 2 mm and 4 mm.

4. The container-making method defined in claim 1, further comprising the step of supporting the partition between the shells on webs bridging the chamber and bearing on the shells.

5. The container-making method defined in claim 1 further comprising the step of supporting the partition between the shells on an inner array of inner webs and an outer array of outer webs.

6. The container-making method defined in claim 5 wherein the partition is shaped to fit complementarily with the inner and outer webs.

7. The container-making method defined in claim 5 wherein the inner and outer webs are arrayed in pairs interconnected by respective inner and outer bridges secured to the respective shells.

8. The container-making method defined in claim 5 wherein the partition is welded to the webs.

9. The container-making method defined in claim 1 wherein the one compartment is the second compartment, whereby the aggregate and cement/water suspension are introduced into the same compartment.

10. The container-making method defined in claim 9 wherein the one and second compartment are an inner compartment adjacent the inner shell, the other and first compartment being an outer compartment adjacent the outer shell.

* * * * *